United States Patent [19]

Koskivirta

[11] 4,319,540

[45] Mar. 16, 1982

[54] METHOD AND APPARATUS FOR DOCKING AND UNDOCKING IN LIGHTER-ABOARD-SHIP VESSELS OF THE FLOATER TYPE

[75] Inventor: Veikko Koskivirta, Vantaa, Finland

[73] Assignee: Valmet Oy, Finland

[21] Appl. No.: 66,835

[22] Filed: Aug. 15, 1979

[30] Foreign Application Priority Data

Aug. 21, 1978 [FI] Finland ..... 782553

[51] Int. Cl.[3] ..... B63B 35/40

[52] U.S. Cl. ..... 114/260

[58] Field of Search ..... 114/259, 260, 45, 258

[56] References Cited

U.S. PATENT DOCUMENTS 3,191,568 6/1965 Schroeder et al. ..... 114/260

4,147,123 4/1979 Kirby et al. ..... 114/260

*Primary Examiner*—George E. A. Halvosa

*Assistant Examiner*—Jesús D. Sotelo

*Attorney, Agent, or Firm*—Steinberg & Raskin

[57] ABSTRACT

A method and apparatus for facilitating the entry or docking and exit or undocking of lighters into and from the docking space of a lighter-aboard-ship vessel of the floater type and for preventing entry of foreign objects into the docking space includes drawing water out of the docking space during entry of the lighter into the docking space, the docking space having been previously filled with water in an amount sufficient to permit the lighter to float therein, in an amount such that outflow of water from the docking space in the region of the gap defined between the lighter and the docking space gate is reduced to an extent whereby substantially no resistance to the entry of the lighter into the docking space will occur. During exit of the lighter from the vessel docking space, water is introduced into the docking space in an amount such that a small outflow of water from the docking space in the region of the gap defined between the lighter and the docking space gate is maintained. Appropriate apparatus is disclosed for drawing and introducing water from and into the docking space as described above. In this manner, the flow of water from and to the docking space which normally accompanies the entry and exit of a lighter into and from the docking space and its consequent resistance to such entry and exit are substantially eliminated and, instead, a relatively small outward flow from the docking space is provided during both entry and exit of the lighter.

5 Claims, 4 Drawing Figures

METHOD AND APPARATUS FOR DOCKING AND UNDOCKING IN LIGHTER-ABOARD-SHIP VESSELS OF THE FLOATER TYPE

BACKGROUND OF THE INVENTION

This invention relates generally to methods and apparatus for use in connection with lighter-aboard-ship (LASH) vessels of the floater type and, more particularly, to a method and apparatus for facilitating the entry and exit of lighters into and from such lighter-aboard-ship vessels and, additionally, to prevent the entry of foreign objects onto the docking deck due to the inflow of water into the docking space.

As is known, a lighter is a boat which is used for loading or unloading vessels at locations remote from wharves or the like. A lighter-aboard-ship (LASH) vessel of the floater type is characterized by the incorporation therein of a docking space which can be selectively filled with water so as to enable a lighter to dock therewithin and subsequently emptied of water to allow the loading or unloading of the lighter.

More particularly, when, for example, cargo is to be conveyed from a lighter to a LASH vessel, the docking space of the vessel is filled with water to an extent sufficient to permit the lighter to float within the docking space. The filling of the docking space with water is accomplished by allowing the water to flow into sinking tanks located between the hull walls until the docking deck which comprises the bed or floor of the docking space descends to at least a depth equal to the draft of the lighter in the surrounding waters. Water is introduced into the docking space through valves which are conventionally located in the docking space bed.

The lighter or lighters can then be floated into the basin defining the docking space through the usual gate or gates, the lighters being urged into the docking space usually with the assistance of a tug boat or the like. After the lighters are completely located within the docking space basin, the gate is closed whereupon the aforementioned tanks located in the hull of the vessel are evacuated and the docking space emptied of the water contained therein. In this manner the LASH vessel rises within the water to its normal operating draft and the lighters eventually come to rest on the bed of the vessels docking space.

The undocking or exit of the lighters from the docking space subsequent to unloading the cargo onto the vessel is accomplished by ballasting the vessel so that it descends to its lower draft as described above and filling the docking space basin with water in an amount sufficient to permit the lighters to float within the docking space. The lighters can then float through the docking space gate into the surrounding water again, preferably, with the assistance of a tug or the like.

The above-described conventional procedure for docking and undocking lighters in LASH vessels has a serious problem inherent therein. More particularly, when the lighter floats into the docking space as described above through the gate thereof or, conversely, when the lighter floats out of the docking space through its gate, a volume of water is displaced from and into the docking space in a direction opposite to the direction of travel of the lighter in the region of the gap defined between the lighter and the docking space gate at a velocity which is many times greater than the velocity of the lighter. Such an opposite high velocity displacement of water results in a high resistance to the travel of the lighter as it moves through the gate thereby impeding the docking and undocking procedures. Additionally, in the case where the lighter exits from the docking space, i.e. in the case of undocking, it is not uncommon for foreign objects such as ice floes to be carried into the docking space with the inflowing water creating serious problems of debris and the like.

SUMMARY OF THE INVENTION

Accordingly, one object of the present invention is to provide a new and improved method and apparatus for facilitating the entry or docking and exit or undocking of lighters into and from the docking space of a lighter-aboard-ship vessel of the floater type.

Another object of the present invention is to provide a new and improved method and apparatus for facilitating the entry and exit of lighters into and from the docking space of LASH vessels of the floater type wherein the above-described problems in connection with resistance to lighter travel into and from the docking space are overcome.

Still another object of the present invention is to provide a new and improved method and apparatus as described above wherein the entry of foreign objects into the docking space is eliminated.

Briefly, in accordance with the present invention, these and other objects are attained by providing a method and apparatus wherein the LASH vessel is provided with a pump or a set of pumps which draw water out of the docking space during entry of the lighter into the vessel docking space in an amount such that outflow of water from the docking space in the region of the gap defined between the lighter and the docking space gate is reduced to an extent whereby substantially no resistance to the entry of the lighter into the docking space will exist. In the preferred embodiment, the same pump or set of pumps are adapted to introduce water into the docking space during exit of the lighter therefrom in an amount such that a small outflow of water from the docking space in the region of the gap defined between the lighter and the docking space gate is maintained.

DESCRIPTION OF THE DRAWINGS

A more complete appreciation of the invention and many of the attendant advantages thereof will be readily appreciated as the same becomes better understood by reference to the following detailed description when considered in connection with the accompanying drawings in which.

DESCRIPTION OF THE PREFERRED EMBODIMENTS

Figure 1A:
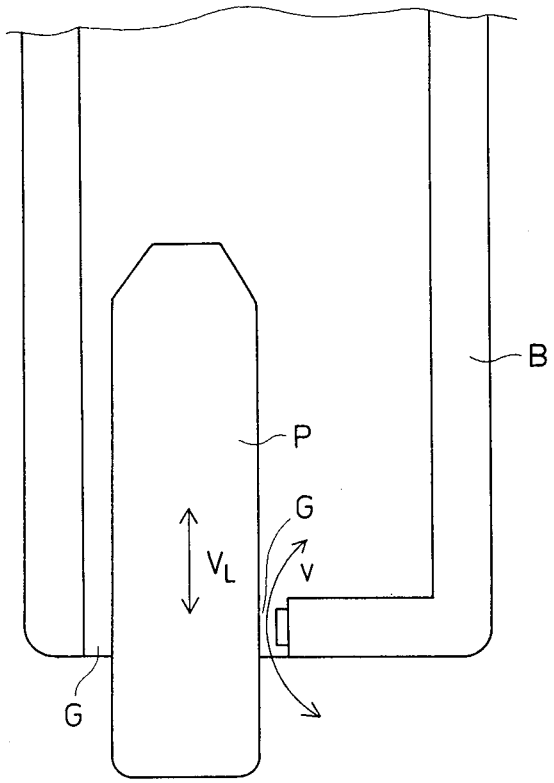
FIG. 1A PRIOR ART
FIGS. 1A and 1B are schematic plan and front elevation views, respectively, illustrating the conventional prior art method and apparatus for docking and undocking lighters in lighter-aboard-ship vessels.
Figure 1B:
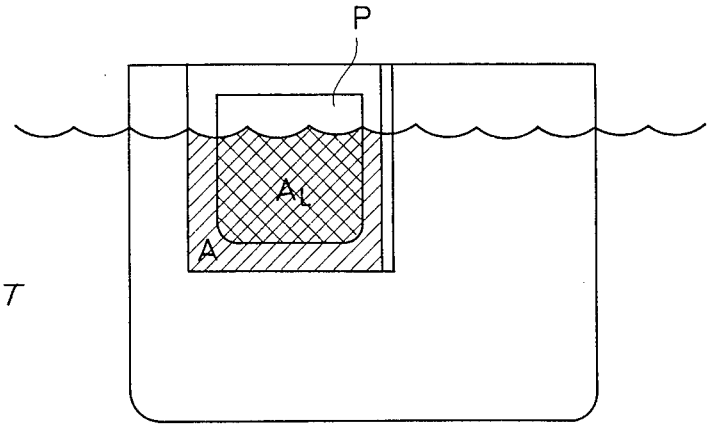
FIG. 1B PRIOR ART

Referring now to the drawings wherein like reference characters designate identical or corresponding parts throughout the several views, and more particularly to FIGS. 1A and 1B which illustrate the prior art conventional method and apparatus for docking and undocking of lighters in lighter-aboard-ship vessels, the lighter P is illustrated during a docking or undocking procedure, i.e., in docking, the lighter P is moving through the gate G inwardly into the docking space B and during undocking, the lighter P is moving outwardly through the gate G from the docking space B. The velocity at which the lighter P is travelling is designated $V_L$. In the case of docking, a volume of water is displaced from the docking space B at a velocity equal to $A_L \times V_L$, where $A_L$ denotes the area of the cross-section of the submerged portion of the lighter P. It therefore follows that at the gate G, there is defined a gap whose cross section, designated A, whose area comprises the difference between the submerged cross section of gate G and the cross-section $A_L$. The water being displaced from the docking space flows through this gap at a velocity V, the direction of which is opposite to the direction in which the lighter P travels. The velocity V at which the displaced water flows is generally many times greater than the velocity $V_L$ of lighter P since the cross-section A is considerably smaller than the submerged cross-section $A_L$ of the lighter P. A consequence of this high velocity flow through the gate G in a direction opposite to the direction of travel of the lighter P is that a large resistance to the travel of the lighter P is created as the latter moves through gate G. Additionally, in the case of undocking where the lighter P moves ouytwardly from the docking space B, foreign objects, such for example as ice floes, tend to be carried into the docking space B along with the inflow of water through gate G.

Figure 2:
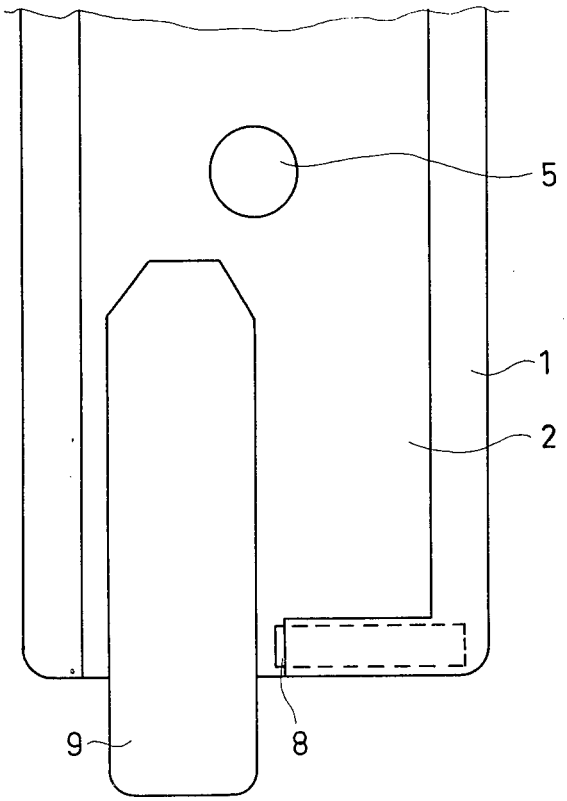
FIG. 2 is a schematic plan view illustrating the method and apparatus of the present invention.
Figure 3:
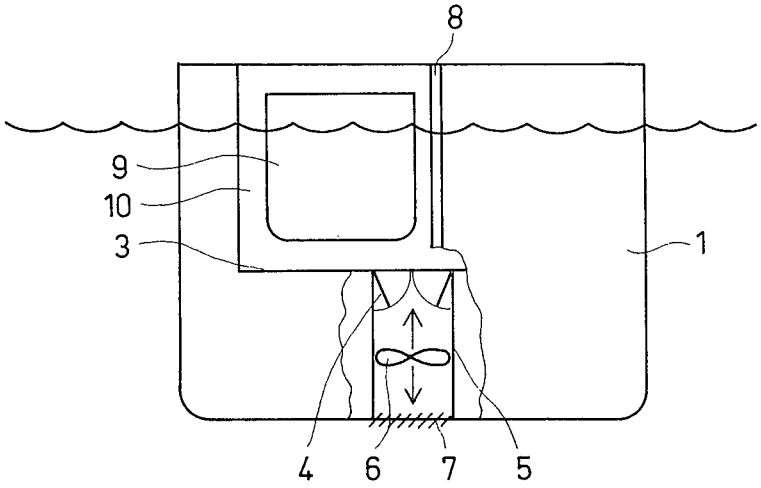
FIG. 3 is a schematic front elevation view illustrating the method and apparatus of the present invention.

Referring now to FIGS. 2 and 3, according to the method and apparatus of the present invention, a water well 5 is formed through the bed or deck 3 of the docking space 2 which opens at its ends at the bottom of the vessel 1 and into the docking space 2, respectively. A valve 4 is located within well 5 and a 2-directional pump, schematically illustrated at 6, is also provided within the well 5. A grating 7 preferably overlies the lower end of well 5 to prevent the entry of foreign objects into the well when pump 6 functions to introduce water into the docking space 2.

In a docking operation, the docking space 2 is filled with water and the vessel 1 submerged as described above so that the bed 3 is at least at a level somewhat below the draft of the lighter 9. The docking space gate 8 is opened whereupon the lighter 9 approaches the gate. As the lighter 9 begins its entry into the gate area, the valve 4 is opened and the pump 6 operated in a manner such that water is drawn from the docking space 2 so as to be expelled through the bottom end of well 5 into the surrounding water. Th pumping rate is regulated in a manner such that only a small outflow occurs in the region of the gap 10 defined between the gate 8 and lighter 9. In this manner, the lighter 9 will travel through the gate 8 into the docking space 2 encountering only a slight counter-flow of water due to the evacuation of the docking space 2 described above. The small outflow of water from the docking space 2 through gate 8 is maintained so that foreign objects cannot enter into the docking space 2 while the lighter 9 travels thereinto. Of course, it is understood that the pump can be operated at a higher rate so that during such docking, water will flow into the docking space 2 through gate 8. In this situation, the docking of the lighter is further facilitated. Upon the lighter completing its travel through gate 8, the operation of pump 6 is terminated and the gate 8 is closed. The LASH vessel 1 is then raised to its operating draft while the water contained within the docking space 2 is removed. This water removal step is preferably accomplished through the further operation of pump 6 (with valve 4 being opened and gate 8 being closed).

In an undocking operation, the docking space 2 is first filled with water in an amount sufficient to permit the lighter to float within the docking space 2. This filling of the docking space is preferably accomplished by opening valve 4 in well 5 and operating the pump 6 in a manner such that water is introduced into the docking space. In this connection, such an introduction of water into the docking space preferably is accomplished from under the bottom of vessel 1 since the entry of foreign objects, such as ice floes, is least probable, especially in view of the provision of grating 7.

After the docking space is filled with water so that the lighter 9 is floated, the gate 8 is opened and the lighter 9 begins its exit from the gate, preferably with the assistance of a tug or the like. As the lighter 9 enters the gate 8, the pump 6 begins its operation in a manner such that water is introduced into the docking space 2 from the surrounding water. The pump 6 is operated at a rate such that the direction of flow of water through the gap 10 is maintained in an outward direction. In this manner, the lighter 9 will float outwardly from the docking space 2 and the outward flow of water through gap 10 will tend to push from the area of the gate any foreign objects which may float on the surface. Upon the lighters completely exiting from docking space 2, the gate 8 is closed as is valve 4 and the operation of pump 6 is terminated.

Although only a single pump and associated structure is illustrated in FIGS. 2 and 3, it is understood that a set of pumps may be utilized in this connection so that the control of the water flow can be varied throughout greater ranges than would otherwise be possible with a single pump.

It is seen that by the method and apparatus of the present invention, the loading and unloading of lighter-aboard-ship vessels of the floater type is substantially facilitated with the additional advantage that costly damage to the lighters and docking space decks which might be caused by the introduction of foreign objects entering into the docking space is prevented.

Obviously, numerous modifications and variations of the present invention are possible in the light of the above teachings. It is therefore to be understood that within the scope of the appended claims, the invention may be practiced otherwise than as specifically disclosed herein.

What is claimed is:

1. A method for facilitating the entry or docking and exit or undocking of lighters into and from the docking space of a lighter-aboard-ship vessel of the floater type and for preventing the entry of foreign objects onto the docking deck of the docking space, comprising the steps of:

during entry of the lighter into the vessel docking space through the gate thereof, the docking space having previously been filled with water in an amount sufficient to permit the lighter to float therein, drawing water out of the docking space in an amount such that a small outflow of water from the docking space in the region of the gap defined between the lighter and the docking space gate is maintained such that only a small resistance to the entry of the lighter into the docking space exists; and during exit of the lighter from the vessel docking space through the gate thereof, the docking space having been previously emptied of water to allow loading or unloading of the lighter and then filled with water in an amount sufficient to permit the lighter to float therein, introducing water into the docking space in an amount such that a small outflow of water from the docking space in the region of the gap defined between the lighter and the docking space gate is maintained.

2. A method as recited in claim 1 wherein the step of drawing water out of the docking space is accomplished by at least one pump.

3. A method as recited in claim 2 wherein the step of introducing water into the docking space is accomplished by at least one pump.

4. A method as recited in claim 2 wherein said at least one pump is also utilized for introducing water into the docking space.

5. A method as recited in claim 4 wherein said at least one pump is also used for filling and emptying the docking space with water.

* * * * *